US005337763A

United States Patent [19]

Haber et al.

[11] Patent Number: 5,337,763

[45] Date of Patent: Aug. 16, 1994

[54] MULTI-USE HAIR PIECE

[76] Inventors: Judy Haber, 2942 W. 60th Dr., Merrillville, Ind. 46410; Sharon Haber, 610 Franciscan Dr.; Greta S. Lambert, 1031 E. Summit, both of Crown Point, Ind. 46307

[21] Appl. No.: 827,160

[22] Filed: Jan. 28, 1992

[51] Int. Cl.[5] ..... A41G 5/00

[52] U.S. Cl. ..... 132/54; 132/53; 2/174

[58] Field of Search ..... 132/53, 54, 56; 2/174, 2/207

[56] References Cited

U.S. PATENT DOCUMENTS

| | | | |
|---|---|---|---|
| D. 205,576 | 8/1966 | Day | 132/54 |
| 1,346,718 | 7/1920 | Muller | 132/53 |
| 2,567,119 | 9/1951 | Naidor | 132/53 |
| 2,574,558 | 11/1951 | Graber et al. | 2/207 |
| 2,651,310 | 9/1953 | Selson | 2/207 |
| 2,789,567 | 4/1957 | Jacoby | 132/53 |
| 2,889,557 | 6/1959 | Blair | 2/174 |
| 3,460,546 | 8/1969 | Abbott | 132/53 |
| 4,492,242 | 1/1985 | Dalton | 132/53 |
| 4,599,749 | 7/1986 | Childs et al. | 132/53 |
| 4,804,003 | 2/1989 | Moen | 132/53 |
| 4,825,886 | 5/1989 | Allen | 132/54 |
| 4,966,173 | 10/1990 | Russell | 132/54 |

FOREIGN PATENT DOCUMENTS

| | | | |
|---|---|---|---|
| 159420 | 3/1921 | United Kingdom | 132/54 |

*Primary Examiner*—Gene Mancene
*Assistant Examiner*—Frank A. LaViola
*Attorney, Agent, or Firm*—Wood, Phillips, Van Santen, Hoffman & Ertel

[57] ABSTRACT

A multi-use hair piece kit is disclosed. The kit includes a support to be worn across the head of a wearer from near one ear to near the other ear, said support being generally conformable to the shape of the head of the wearer. The kit also includes a hair piece for covering a portion of the head of the wearer. The hair piece includes a flexible base, and hair strands attached to and extending outwardly from one side of the base. The hair piece is removably attached to the support and conforms to the shape of the support.

13 Claims, 3 Drawing Sheets

MULTI-USE HAIR PIECE

BACKGROUND OF THE INVENTION

1. Field of the Invention

The present invention relates to a hair piece to be used in supplementing the existing hair of the wearer, and more specifically, relates to a hair piece that can be used for both therapeutic and cosmetic enhancement of the hair of the wearer without requiring any hair pins for securing the hair piece on the head of the wearer. The hair piece of the present invention may be used in combination with a variety of supports for securing the hair piece in place to give the wearer multiple options in appearance and use of the hair piece.

2. Description of the Prior Art

Wigs, wiglets and falls are well known. Such hair pieces have proven disadvantageous in some respects. For example, conventional wigs, wiglets and falls require pinning to the natural hair of the wearer to secure the hair piece in place. For wearers who have lost much of their natural hair, such as patients experiencing hair loss as a side effect of chemotherapy, conventional wigs, wiglets and falls may not be comfortably worn. Moreover, conventional hair pieces are not generally versatile, and more than one hair piece may be required to achieve different appearances.

SUMMARY OF THE INVENTION

It is an object of the present invention to provide a cranial prosthesis for the therapeutic enhancement of the hair of people who have experienced hair loss as a side effect of cancer therapy.

It is a further object of the present invention to provide a hair piece for the cosmetic enhancement of the natural hair of the wearer.

It is a further object of the present invention to provide a hair piece that can be securely placed on the head of the wearer without the use of hair pins, adhesives or weaving of the natural hair of the wearer into the hair piece.

It is a further object of the invention to provide such a hair piece that can be worn by a wearer having little or no natural hair in the vicinity of the hair piece.

It is a further object of the present invention to provide a hair piece that can be worn on a resilient plastic head band.

It is a further object of the present invention to provide such a hair piece that can be alternatively worn attached to a snood or scarf.

It is a further object of the present invention to provide a hair piece that can be attached to a variety of support means for wearing on the wearer's head.

It is a further object of the present invention to provide such a hairpiece that conforms to the contour of the support means.

It is a further object of the present invention to provide a hair piece kit that includes a hair piece and a support means for the hair piece so that the hair piece can be removably attached to the support means for wearing.

It is a further object of the present invention to provide such a hair piece that can be readily transferred from one type of support means to another to provide the wearer with styling alternatives using a single hair piece.

In one aspect, the present invention provides a multi-use hair piece kit comprising a support means to be worn across the top of the head of a wearer from near one ear to near the other ear, said support means being generally conformable to the shape of the head of the wearer, a hair piece for covering a portion of the head of the wearer, the hair piece including, a flexible base, hair strands attached to and extending outwardly from one side of the base, and means for removably attaching the hair piece to the support means so that the flexible base of the hair piece conforms to the shape of the support means.

In another aspect, the present invention provides a removable cranial prosthesis to be worn on an auxiliary support means. The cranial prosthesis comprises a flexible, substantially oval base having a major longitudinal axis and a minor transverse axis dividing the base into front and rear portions. The base has front and rear edges which converge from the minor transverse axis toward the major longitudinal axis so that the base is widest at the minor transverse axis and most narrow at the ends of the major longitudinal axis. the cranial prosthesis also includes a plurality of substantially parallel linear wefts of hair attached to one side of the base and extending outwardly from one side of the base. The linear wefts of hair are substantially parallel to the major longitudinal axis of the base. A plurality of linear wefts of hair are disposed on the front portion of the base and are directed in one direction and a plurality of linear wefts of hair are disposed on the back portion of the base with a plurality of the wefts of hair on the rear portion of the base being directed in the same direction as the wefts of hair on the front portion of the base. A plurality of wefts of hair on the rear portion of the base are directed in the opposite direction. The cranial prosthesis also includes means for removably attaching the base to the auxiliary support means.

In yet another aspect, the present invention provides a means for supplementing the existing hair of a person. The means comprises the combination of a generally U-shaped band of resilient material extending across the top of the wearer's head from near one ear of the wearer to near the other ear of the wearer and a hair piece removably attached to the generally U-shaped band. The hair piece includes a base having one side Juxtaposed with the top of the wearer's head. The base defines a sleeve through which the generally U-shaped band extends. The contour of the base substantially conforms with the contour of the generally U-shaped band, and the base is dimensioned and shaped to span the top of the wearer's head and to extend to the wearer's temples and to extend across a substantial portion of the top of the wearer's head between the crown and the natural hairline of the wearer at the wearer's forehead. The hair piece further includes a plurality of hair strands extending outwardly from the opposite side of the base and intermingled with the wearer's natural hair.

DETAILED DESCRIPTION OF THE ILLUSTRATED EMBODIMENT

The illustrated hair piece is adapted to be removably attached to a support means, which support means is then placed on the head of the wearer. The hair piece is generally flexible along its longitudinal axis so that the hair piece conforms to the contour of the support means, which also generally conforms to the shape of the head of the wearer. The support means are interchangeable so that the hair piece may be worn on a resilient head band, on a hat, turban or scarf, for example.

Figure 1:
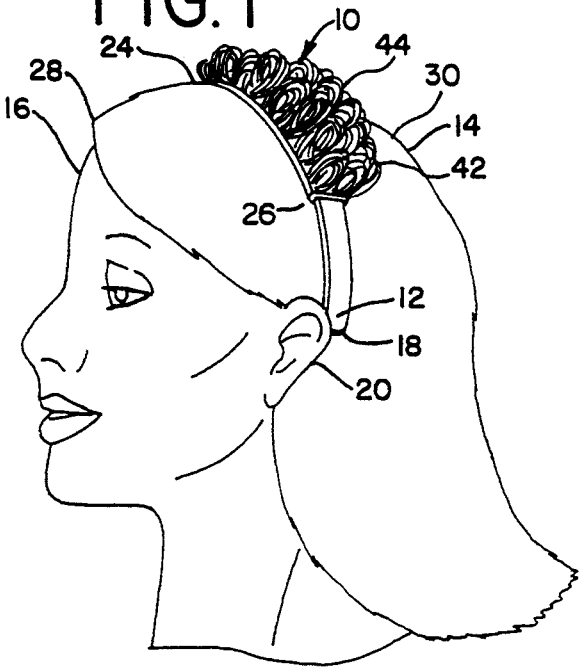
FIG. 1 is a schematic side view of the head and neck of a person wearing the hair piece of the present invention supported by a resilient head band, with portions of the wearer's natural hair removed for clarity of illustration.
Figure 3A:
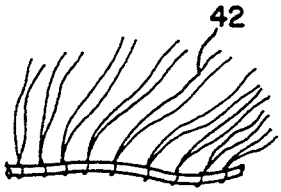
FIG. 3A is an enlarged view of a weft of hair.

Use of the hair piece of the present invention on one alternative support means is illustrated in FIG. 1. As there illustrated, the hair piece 10 may be worn on a resilient head band 12 on the head 14 of a wearer 16. The head band 12 extends from one free end 18 positioned slightly behind one ear 20 of the wearer 16 to a second free end 22, shown in FIG. 2, positioned slightly behind the opposite ear of the wearer. The hair piece 10 is centered longitudinally on the head band, and is sized to extend across the top 24 of the wearer's head 14 and to extend slightly into the areas of the wearer's temples 26. Laterally, the hair piece is sized to fit between the wearer's natural hairline 28 at the wearer's forehead and the crown 30 of the wearer's head.

Figure 2:
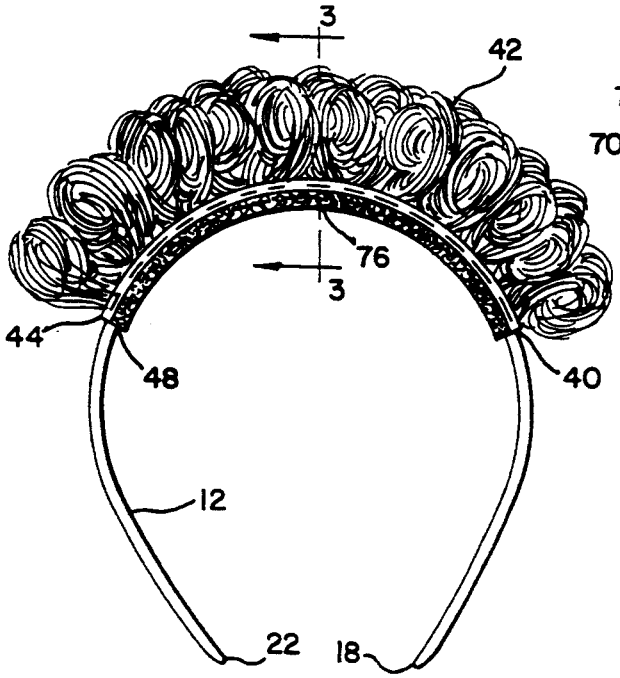
FIG. 2 is front view of the hair piece of the present invention in place on a resilient head band.
Figure 3:
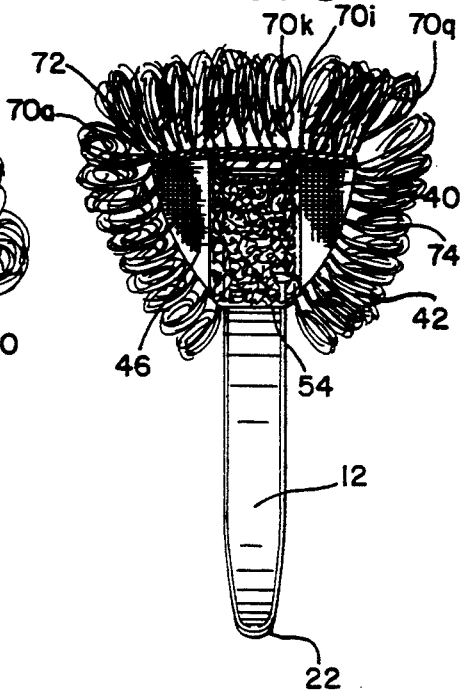
FIG. 3 is a cross sectional view of the hair piece of the present invention, taken along line 3—3 of FIG. 2.

As shown in FIG. 2, the head band 12 is a commercially available resilient band of plastic material having a general U-shape, or horse shoe shape. Preferably, the head band is made of a clear plastic material so that it is less visible when worn. Such head bands are generally flexible enough to allow them to be worn by a variety of people with varying head sizes. The bias of the head band tends to hold it in place on the wearer's head. In the illustrated embodiment, the head band is one-half inch wide and may have a plurality of teeth or grooves (not shown) to assist in holding the head band in place.

As shown in FIGS. 2–5, the hair piece 10 of the present invention comprises a base 40 and hair strands 42 extending outwardly from the top side 44 of the base 40. The bottom side 46 of the base 40 is juxtaposed with the wearer's head, and has a longitudinal sleeve 48. The hair piece may be mounted on the head band 12 by sliding the head band through the sleeve on the base. The hair piece is readily removed from the head band by sliding the head band through the sleeve. When mounted on the head band, the contour of the hair piece generally conforms with the contour of the head band, as shown in FIGS. 1 and 2.

Figure 4:
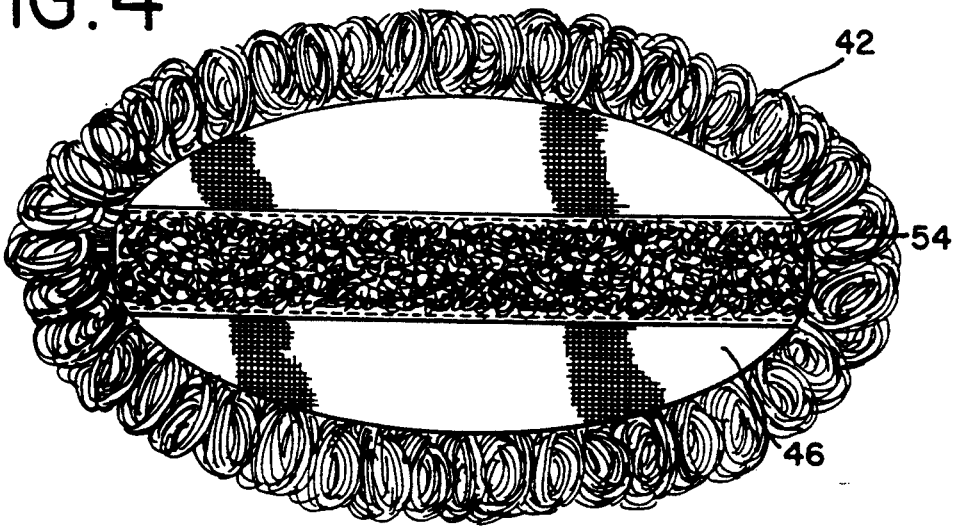
FIG. 4 is view of the bottom side of the hair piece of the present invention.
Figure 5:
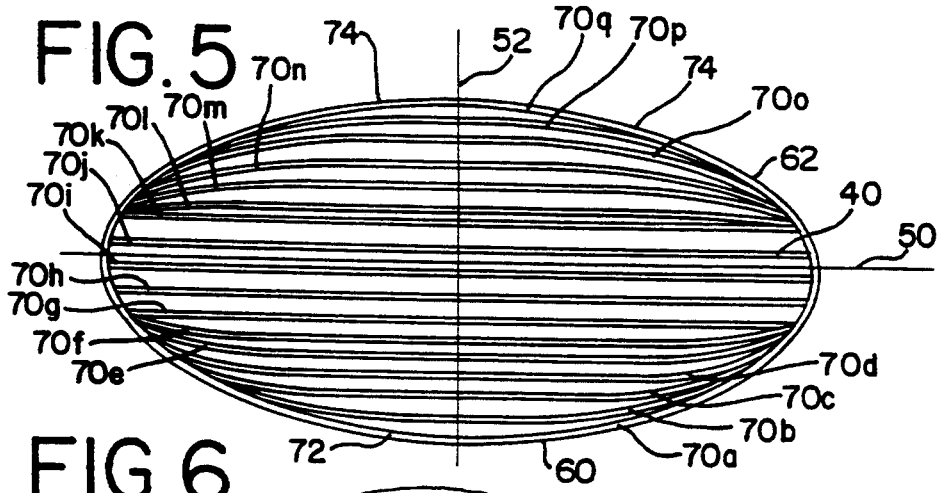
FIG. 5 is a top view of the hair piece of the present invention, with parts of the hair removed to illustrate one pattern of attachment for wefts of hair to the base of the hair piece.

As shown in FIGS. 4 and 5, the hair piece is generally flat when not in place on a support means. When flat, the hair piece base 40 is generally oval shaped, with a major longitudinal axis 50 and a minor lateral axis 52. The base 40 is flexible along the longitudinal axis 50 so that the base and thereby the hair piece generally conforms to the contour of the support means when the hair piece is in place on the support means. Thus, as shown in FIG. 2, the hair piece is curved along the longitudinal axis, conforming to the curve of the head band, when in place on the head band.

In the illustrated embodiment, the longitudinal sleeve 48 defines one possible means for removably attaching the hair piece to the support means, while allowing the hair piece to conform to the shape of the support means. The longitudinal sleeve 48 is formed by sewing an elongate strip of fastening material 54 onto the bottom side 46 of the base 40. Preferably, the fastening material 54 is the soft loop side of a hook and loop fastening material. A mating strip of the hook side of the fastening material may be secured to alternative support means. In the illustrated embodiment, the elongate strip of fastening material is of the type sold under the trade name "VELCRO". It is sewn to the base along two edges of the fastening material to define the sleeve 48 through which the head band may extend. The width between the stitch lines and the width of the fastening material should be greater than the width of the head band to allow the hair piece to be easily slipped onto and off of the head band; the fit of the head band within the sleeve should be tight enough, however, so that the hair piece does not slide too easily on the head band, so that the hair piece is secure in place when worn on the head band.

The fastening material 54 is parallel to and extends over the longitudinal axis of the base 40. The illustrated base is symmetrical about its minor lateral axis 52, but is asymmetrical about its major longitudinal axis 50 so that the front 60 of the base 40 is wider than the rear 62 of the base. In the illustrated embodiment, the width of the front 60 part of the base from the longitudinal axis and along the minor lateral axis is about one and one-half inches, while the width of the rear 62 part of the base from the longitudinal axis along the minor lateral axis is about one and one-quarter inches. The additional width at the front of the base allows for more hair at the front of the hair piece, to provide added fullness from the head band toward the natural hair line 28 at the forehead when the hair piece is worn on the head band. The length of the illustrated hair piece, along the major longitudinal axis is about five and one-half inches.

With the hair piece so sized, the hair piece is generally long enough to extend across the top of the wearer's head and into the wearer's temples 26, with the more narrow part of the hair piece being at the wearer's temples, to make the hair more manageable when the piece is used on the head band support, to allow the wearer's natural hair at the temples to be intermingled with the hair of the hair piece for a more natural appearance. The base width is sufficient to provide a substantial amount of hair to be added to the wearer's natural hair, for added fullness, and for coverage of a portion of the scalp between the wearer's natural hair line 28 at the forehead and the crown 30 of the head.

The hair strands 42 extending from the top side 44 of the base may be of human hair or may comprise synthetic hair. It should be understood that as used in this patent specification and claims, the term "hair strands" is intended to mean both natural human hair and synthetic fibers. In the illustrated embodiment, the hair strands comprise modacrylic fibers. The hair strands may be hand tied to the base, or may be attached to the base in the form of wefts of hair, or a combination of the two may be used.

In the illustrated embodiment, wefts of modacrylic fiber are used as the hair strands 42. As shown in FIG. 5, seventeen wefts 70*a*–70*q* of hair are sewn to the base. Each weft of hair comprises a flexible substantially linear base from which strands of hair extend in one direction. Each weft of hair 70*a*–70*q* is sewn to the hair piece base 40. The first weft 70*a* of hair is sewn along the front curved edge 72 of the hair piece base 40 with the weft forwardly directed. The seventeenth weft of hair 70*q* is sewn along the rear curved edge 74 of the hair piece base 40. The second through sixteenth wefts of hair 70*b*–70*p* are sewn to the hair piece base 40 in parallel lines substantially parallel to the major longitudinal axis 50 of the hair piece base 40. In the illustrated embodiment the first through the eleventh wefts of hair 70*a*–70*k* are sewn to the base with the wefts forwardly directed. Wefts twelve through seventeen 70*l*–70*q* are sewn to the base with the wefts rearwardly directed.

The majority of the parallel wefts 70*b*–70*b* are generally evenly spaced on the hair piece base 40. Thus, wefts two through eleven 70*b*–70*k* and wefts twelve through sixteen 70*l*–70*p* are spaced about three-sixteenths of an inch apart. However, wefts eleven 70*k* and twelve 70*l* are closely abutted to each other. Thus the wefts are closely abutted where the weft direction changes.

As illustrated in FIG. 1, the front 72 and rear 74 curved edges of the base converge toward each other so that the base 40 is widest at its center, at the center 76 of the head band 12, on the top of the wearer's head, and most narrow at the wearer's temples 26.

The strip of fastening material 54 is about three-quarters to one inch wide in the illustrated embodiment, and is placed so that the front line of stitching attaching the strip to the hair piece base 40 is between the sixth 70*f* and seventh wefts 70*g* of hair and the rear line of stitching attaching the strip to the hair piece is at the abutment of the eleventh 70*k* and twelfth 70*l* wefts of hair. This configuration of the attachment of the wefts of hair alleviates the formation of a ridge at the change of weft direction and at the attachment of the strip of fastening material to the base. With a three-quarter inch strip of fastening material, a one-half inch wide head band should be easily slipped into and out of the sleeve 48 defined by the strip 54 and the hair piece base 40.

The hair piece of the present invention may have a preset curl pattern. In the illustrated embodiment, all seventeen wefts of hair have a rearward curl pattern formed by curling on one inch rods. Alternative curl patterns may be employed. For example, wefts fifteen 70*o* through seventeen 70*q* may not be curled, but left straight. Depending upon the range of styles to be used with the hair piece, all of the hair may be left straight. In addition, the hair may be pre-teased, or may be crimped near to the hair piece base 40 for added fullness.

In the illustrated embodiment, the length of the hair of the hair piece is about five and one-half inches. However, the length of the hair may be varied, for example with position, on the hair piece. For example, the rear wefts of hair may be longer.

Figure 6:
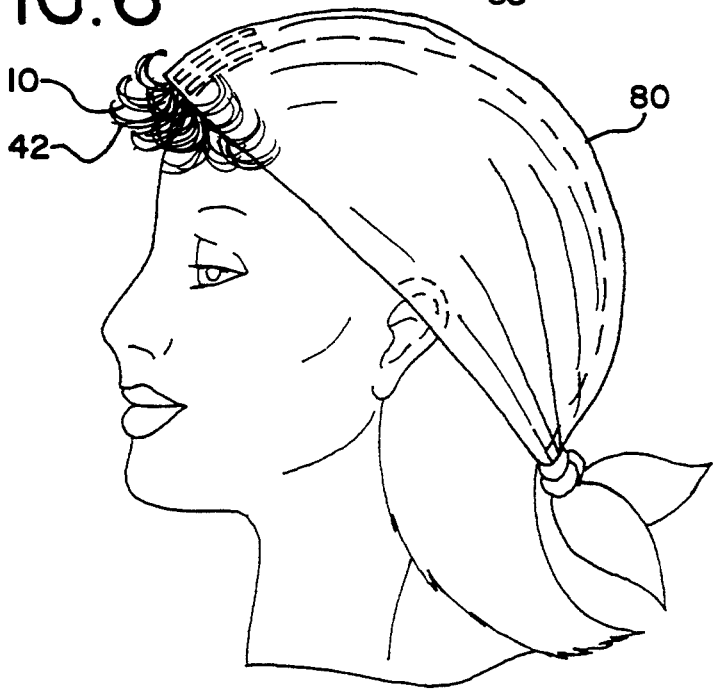
FIG. 6 is a schematic side view of the hair piece of the present invention removably attached to an alternate support means, that is, a snood worn around the head of the wearer.
Figure 7:
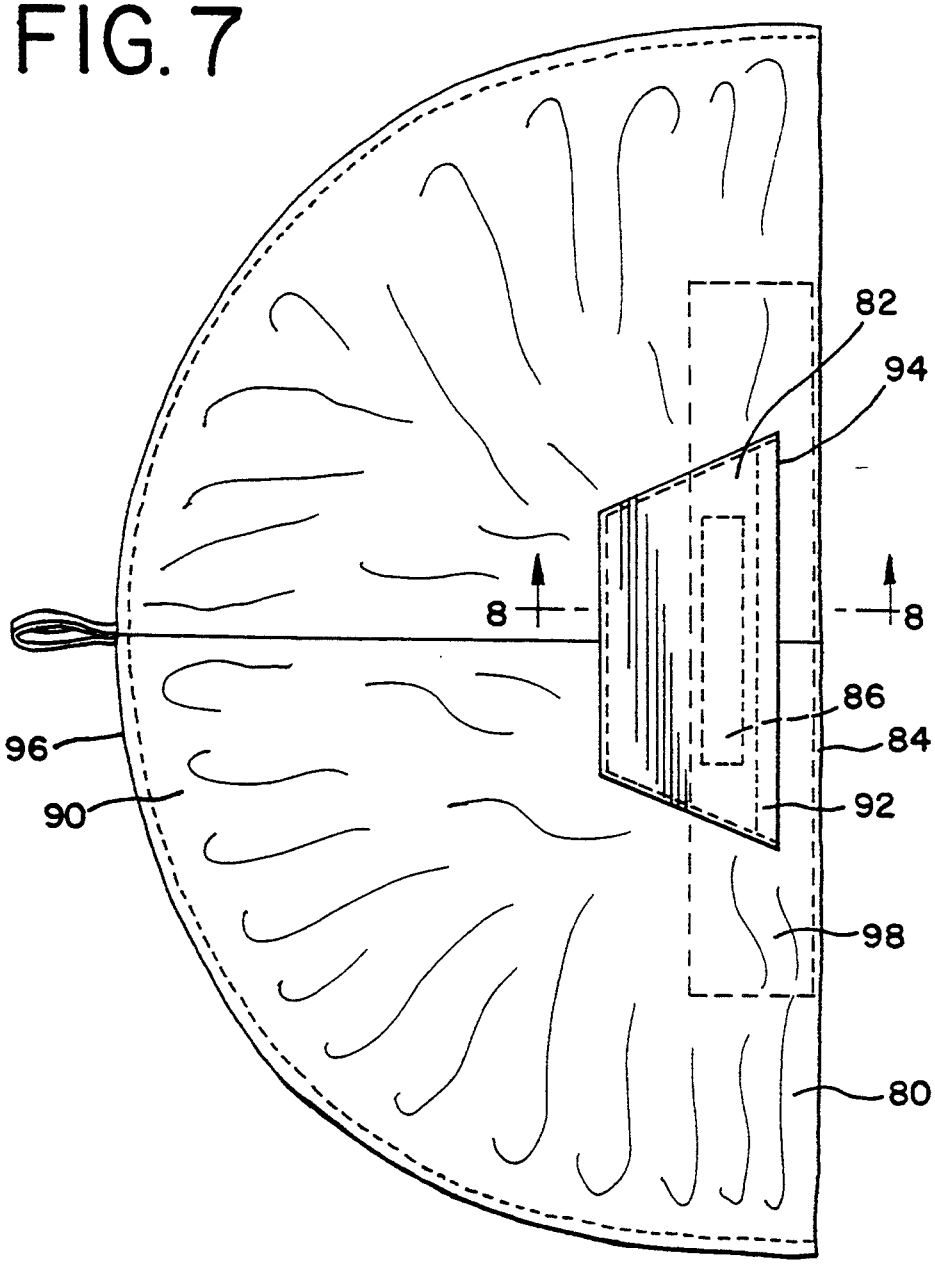
FIG. 7 is a bottom plan view of the snood of FIG. 6.
Figure 8:
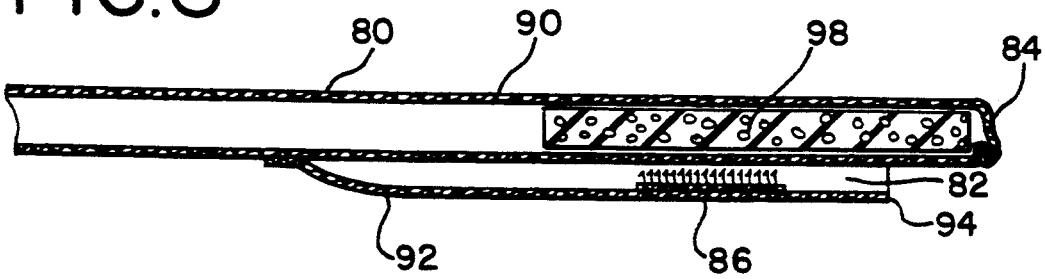
FIG. 8 is a cross sectional view of the snood of FIG. 7, taken along line 8—8 of FIG. 7.

As illustrated in FIGS. 6–8, the hair piece of the present invention may be used interchangeably on a variety of support means. As there illustrated, the hair piece is shown in use with a snood 80 or scarf. The illustrated snood 80 defines a pocket 82 near the front edge 84. A mating strip of fastening material 86 is sewn into the pocket 82, and the fastening material 54 of the hair piece base 40 is thereby removably attached to the snood. The pocket 82 is large enough to hold the entire base flat.

As shown in FIG. 7, the snood 80 comprises two mating generally semi-circular pieces of material 90, or a circular piece of material folded along a diagonal defining the front edge 84, with a smaller trapezoidal piece of material 92 sewn along three of its edges to one side of the semi-circular piece of material 90 near and centered long the front edge 84. The front edge 94 of the trapezoidal material is not sewn to the semi-circular piece of material, but is left open to define the pocket 82 into which the hair piece may be inserted. The semi-circular edge 96 of the snood defines a sleeve through which a string is threaded for gathering the snood around the head of the wearer. An elongate strip of padding 98, which is a thin strip of a soft plastic foam material in the illustrated embodiment, is sewn within the semicircular pieces of material near to the front edge 84. The padding serves prevent any visible lumps where the hair piece fits within the pocket. When the snood is worn, the front edge 84 conforms to the shape of the wearer's head, thereby conforming the hair piece to the shape of the wearer's head.

The hair piece of the present invention may also be worn with other support means. For example, a flexible turban or ring of stretchy fabric may have a mating strip of fastening material attached for attaching the hair piece to those support means when desired. It should also be understood that other means for removably attaching the hair piece to the support means may be used and are within the scope of the invention as claimed. For example, a plurality of snaps could be attached to one or both sides of the base 40 along the major longitudinal axis 50, with mating snaps attached to a head band and other support means. In addition, such snaps could be used in combination with the longitudinal sleeve of the illustrated embodiment, as for example, sewing snaps on the top side of the base along the major longitudinal axis, with a longitudinal sleeve sewn on the bottom side of the base, as illustrated. In such an embodiment, the hair piece could also be used with other support means, such as a decorative head band, with the head band being exposed above the hair piece.

We claim:

1. A multi-use hair piece kit for use on the head of a person, the kit comprising:

a support means to be worn across the head of a wearer from near one ear to near the other ear;

a hair piece for covering a portion of the head of the wearer, the hair piece including, a flexible base;

hair strands attached to and extending outwardly from one side of the base; and means for removably attaching the hair piece to the support means, said means permitting the flexible base of the hair piece to conform to the shape of the support means.

wherein the flexible base of the hair piece has an elongated substantially oval shape with a major axis and a minor axis and wherein the means for removably attaching the hair piece to the support means comprises an elongate strip of the loop side of a hook and loop fastening material sewn to the hair piece base to define a sleeve along the major longitudinal axis of the base.

2. A multi-use hair piece kit as claimed in claim 1 wherein the major axis divides the hair piece base into front and back portions, the base being symmetrical about the minor axis and asymmetrical about the major axis so that the front portion of the base is wider than the back portion of the base, the elongate strip being substantially centered on the major axis of the base.

3. A multi-use hair piece kit as claimed in claim 2 wherein the hair strands comprise a plurality of wefts of hair attached to the base in substantially parallel lines substantially parallel to the major axis of the base.

4. A removable hair piece to be worn on an auxiliary support means, the hair piece comprising:

a flexible, substantially oval base having front and rear edges and a major longitudinal axis and a minor transverse axis dividing the base into front and rear portions, the front and rear edges of the base converging from the minor transverse axis toward the major longitudinal axis so that the base is widest at the minor transverse axis and most narrow at the ends of the major longitudinal axis;

a plurality of substantially parallel linear wefts of hair attached to one side of the base and extending outwardly from one side of the base, the linear wefts of hair being substantially parallel to the major longitudinal axis of the base, wherein a plurality of linear wefts of hair are disposed on the front portion of the base and are directed in one direction and a plurality of linear wefts of hair are disposed on the back portion of the base with a plurality of the wefts of hair on the rear portion of the base being directed in the same direction as the wefts of hair on the front portion of the base and a plurality of wefts of hair on the rear portion of the base being directed in the opposite direction; and means for removably attaching the base to the auxiliary support means.

5. A hair piece as claimed in claim 4 wherein the means for removably attaching the base to the auxiliary support means comprises an elongate strip defining a sleeve along the major longitudinal axis of the base, the elongate strip being attached to the opposite side of the base along the longitudinal edges of the strip, the longitudinal edges of the strip being parallel to the major longitudinal axis of the base.

6. A hair piece as claimed in claim 5 wherein one of the longitudinal edges of the elongate strip is attached to the front portion of the base by a front line of stitching, said front line of stitching being disposed between an adjacent pair of linear wefts of hair, wherein and one of the longitudinal edges of the elongate strip is attached to the rear portion of the base by a rear line of stitching, wherein an adjacent pair of wefts of hair are closely abutted along the rear line of stitching.

7. A hair piece as claimed in claim 6 further comprising a weft of hair attached to the base along the front edge of the base and a weft of hair attached to the base along the rear edge of the base.

8. A hair piece as claimed in claim 7 wherein a total of seventeen wefts of hair are attached to the base, the first weft of hair being along the front edge of the base and the seventeenth weft of hair being along the rear edge of the base, and wherein the front line of stitching attaching the elongate strip to the base is between the sixth and seventh wefts of hair, and wherein the eleventh and twelfth wefts of hair are closely abutted at the rear line of stitching attaching the elongate strip to the base.

9. A hair piece as claimed in claim 8 wherein the first through eleventh wefts of hair have a forwardly directed weft direction and the twelfth through seventeenth wefts of hair have a rearwardly directed weft direction.

10. A hair piece as claimed in claim 9 wherein the base is symmetrical about the minor transverse axis of the base and is asymmetrical about the major longitudinal axis of the base so that the front portion of the base is wider than the rear portion of the base.

11. A device for supplementing the existing hair of a person, said device comprising in combination:

a generally U-shaped band of resilient material to extend across the top of the wearer's head from near one ear of the wearer to near the other ear of the wearer;

a hair piece removably attached to the generally U-shaped band, the hair piece including a base having a bottom side to be juxtaposed with the top of the wearer's head, the base including a sleeve on the bottom side of the base through which the generally U-shaped band extends, the contour of the base substantially conforming with the contour of the generally U-shaped band, the base being dimensioned and shaped to span a portion of the top of the wearer's head and to extend substantially to the wearer's temples and to extend across a substantial portion of the top of the wearer's head between the crown and the natural hairline of the wearer at the wearer's forehead,;

wherein the base has a front portion extending forwardly from the center of the U-shaped band and a rear portion extending rearwardly from the center of the U-shaped band, and wherein the front portion of the base is wider than the rear portion of the base:

the hair piece further including a plurality of wefts of hair attached to the front and rear portions of the base, wherein the wefts of hair attached to the front portion of the base and a plurality of the wefts of hair on the rear portion of the base are directed in one direction and a plurality of wefts of hair on the rear portion of the base are directed in an opposite direction.

12. The combination of claim 11 wherein the sleeve is defined by an elongate strip of a loop side of a hook and loop fastening material attached to the base with the loops extending toward the wearer's scalp, the elongate strip being attached to the base by a front line of stitching and a rear line of stitching, the front line of stitching lying between a pair of adjacent wefts of hair and the rear line of stitching lying between a pair of adjacent wefts, the pair of adjacent wefts at the rear line of stitching being closely abutted to each other.

13. The combination of claim 12 wherein the base has a front edge and a rear edge, the base being widest at the center of the band at the top of the wearer's head, the front and rear edges converging toward each other from the widest part of the base so that the base is most narrow substantially at the wearer's temples.

* * * * *